US007116303B2

(12) United States Patent
Park

(10) Patent No.: US 7,116,303 B2
(45) Date of Patent: Oct. 3, 2006

(54) APPARATUS AND METHOD OF DRIVING LIQUID CRYSTAL DISPLAY DEVICE

(75) Inventor: Kwang Soon Park, Daegu-kwangyokshi (KR)

(73) Assignee: LG.Philips LCD Co., Ltd., Seoul (KR)

( * ) Notice: Subject to any disclaimer, the term of this patent is extended or adjusted under 35 U.S.C. 154(b) by 236 days.

(21) Appl. No.: 10/395,260

(22) Filed: Mar. 25, 2003

(65) Prior Publication Data

US 2004/0119673 A1 Jun. 24, 2004

(30) Foreign Application Priority Data

Dec. 20, 2002 (KR) ..... 10-2002-0081980

(51) Int. Cl.
*G09G 3/36* (2006.01)

(52) U.S. Cl. ..... 345/92; 345/87; 345/94

(58) Field of Classification Search ..... 345/87–100
See application file for complete search history.

(56) References Cited

U.S. PATENT DOCUMENTS 6,392,620 B1 * 5/2002 Mizutani et al. ..... 345/88
6,414,665 B1 * 7/2002 Libsch et al. ..... 345/92
6,476,787 B1 * 11/2002 Libsch et al. ..... 345/92
6,522,319 B1 * 2/2003 Yamazaki ..... 345/103
2004/0119671 A1 * 6/2004 Kim et al. ..... 345/87

* cited by examiner

*Primary Examiner*—Bipin Shalwala
*Assistant Examiner*—David L. Lewis
(74) *Attorney, Agent, or Firm*—McKenna Long & Aldridge LLP

(57) ABSTRACT

An apparatus and method of driving a liquid crystal display device are disclosed in the present invention. The liquid crystal display device includes a plurality of data lines in a first direction, a plurality of gate lines in a second direction to cross the data lines, a plurality of first liquid crystal cells on a first side with respect to the data lines, a plurality of second liquid crystal cells on a second side with respect to the data lines, a first switching part in each first liquid crystal cell and controlled by a current gate line and a next gate line, and a second switching part in each second liquid crystal cell and controlled by the current gate line and a previous gate line.

46 Claims, 7 Drawing Sheets

APPARATUS AND METHOD OF DRIVING LIQUID CRYSTAL DISPLAY DEVICE

This application claims the benefit of the Korean Patent Application No. P2002-081980 filed on Dec. 20, 2002, which is hereby incorporated by reference.

BACKGROUND OF THE INVENTION

1. Field of the Invention

The present invention relates to a liquid crystal display device, and more particularly, to an apparatus and method of driving a liquid crystal display device. Although the present invention is suitable for a wide scope of applications, it is particularly suitable for reducing the number of data lines and the number of data driver IC's.

2. Discussion of the Related Art

A liquid crystal display controls light transmittance of liquid crystals by using an electric field to display a picture. To this end, the liquid crystal display includes a liquid crystal display panel having a pixel matrix and a driving circuit for driving the liquid crystal display panel. The driving circuit drives the pixel matrix so that picture information can be displayed on the display panel.

FIG. 1 illustrates a related art liquid crystal display device.

Referring to FIG. 1, the related art liquid crystal display device includes a liquid crystal display panel 2, a data driver 4 driving a plurality of data lines DL1 to DLm of the liquid crystal display panel 2, a gate driver 6 driving a plurality of gate lines GL1 to GLn of the liquid crystal display panel.

The liquid crystal display panel 2 further includes a thin film transistor TFT formed at each intersection of the gate lines GL1 to GLn and the data line DL1 to DLm, and liquid crystal cells connected to the thin film transistors and arranged in a matrix.

The gate driver 6 sequentially applies gate signals to the gate lines GL1 to GLn in accordance with control signals from a timing controller (not shown). The data driver 4 converts data R, G, and B supplied from the timing controller into video signals as analog signals, and applies the video signals of one horizontal line portion to the data lines DL1 to DLm for each horizontal period when the gate signals are applied to the gate lines GL1 to GLn.

The thin film transistor TFT applies data from the data lines DL1 to DLm to the liquid crystal cells in response to the gate signals from the gate lines GL1 to GLn. The liquid crystal cell is composed of a pixel electrode connected to the TFT and a common electrode facing into each other with the liquid crystal therebetween, thus it can be expressed equivalent to a liquid crystal capacitor Clc. Such a liquid crystal cell includes a storage capacitor (not shown) connected to the previous gate line in order to sustain the data voltage charged in the liquid crystal capacitor Clc until the next data voltage is charged.

In this way, the liquid crystal cells of the related art liquid crystal display panel are located at intersections of the gate lines GL1 to GLn and the data lines DL1 to DLm, respectively. Thus, there are vertical lines formed as many as the data lines DL1 to DLm (i.e., m vertical lines). In other words, the liquid crystal cells are arranged in a matrix to form m vertical lines and n horizontal lines.

As can be seen here, the m data lines DL1 to DLm are required for driving the liquid crystal cells of the m horizontal lines. Accordingly, there is a disadvantage in that the processing time and fabricating cost are not efficient because a plurality of data lines DL1 to DLm are formed for driving the liquid crystal display panel 2 in the related art. Further, there is a problem in that the fabricating cost becomes high because a number of data driver IC's are required in the data driver 4 for driving each of the m data lines DL1 to DLm.

SUMMARY OF THE INVENTION

Accordingly, the present invention is directed to an apparatus and method of driving a liquid crystal display device that substantially obviate one or more of problems due to limitations and disadvantages of the related art.

Another object of the present invention is to provide an apparatus and method of driving a liquid crystal display device that are adaptive for reducing the number of data lines and the number of data driver IC's.

Additional features and advantages of the invention will be set forth in the description which follows and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a liquid crystal display device includes a plurality of data lines in a first direction, a plurality of gate lines in a second direction to cross the data lines, a plurality of first liquid crystal cells on a first side with respect to the data lines, a plurality of second liquid crystal cells on a second side with respect to the data lines, a first switching part in each first liquid crystal cell and controlled by a current gate line and a next gate line, and a second switching part in each second liquid crystal cell and controlled by the current gate line and a previous gate line.

Herein, the first switching part applies a video signal supplied to the data lines to the first liquid crystal cell when a gate signal is applied to the current gate line and the next gate line.

Herein, the second switching part applies a video signal supplied to the data lines to the second liquid crystal cell when a gate signal is applied to the current gate line and the previous gate line.

Herein, the first switching part located in the $i^{th}$ horizontal line applies a video signal supplied to the data lines to the first liquid crystal cell when a gate signal is applied to the $i^{th}$ gate line and $(i+1)^{th}$ gate line, wherein i is a natural number.

Herein, the second switching part located in the $i^{th}$ horizontal line applies a video signal supplied to the data lines to the second liquid crystal cell when a gate signal is applied to the $i^{th}$ gate line and $(i-2)^{th}$ gate line, wherein i is a natural number.

Herein, the first liquid crystal cells and the first switching part are located on the left side of the data lines.

Herein, the second liquid crystal cells and the second switching part are located on the right side of the data lines.

Herein, the first liquid crystal cells and the first switching part are located on the right side of the data lines.

Herein, the second liquid crystal cells and the second switching part are located on the left side of the data lines.

Herein, the first switching part includes a first thin film transistor having a first gate terminal connected to the current gate line and a first source terminal connected to the data lines, and a second thin film transistor having a second gate terminal connected to the next gate line, a second source terminal connected to a first drain terminal of the first thin film transistor, and a second drain terminal connected to the first liquid crystal cells.

Herein, the current gate line is the $i^{th}$ gate line, and the next gate line is the $(i+1)^{th}$ gate line, wherein i is a natural number.

Herein, the second switching part includes a third thin film transistor having a third gate terminal connected to the current gate line and a third source terminal connected to the data lines, and a fourth thin film transistor having a fourth gate terminal connected to the previous gate line, a fourth source terminal connected to a third drain terminal of the third thin film transistor, and a fourth drain terminal connected to the second liquid crystal cell.

Herein, the current gate line is the $i^{th}$ gate line, and the previous gate line is the $(i-2)^{th}$ gate line, wherein i is a natural number.

Herein, each of the first to fourth thin film transistors includes a gate electrode on a substrate, a gate insulating layer on the gate electrode, a semiconductor layer on the gate insulating layer, a source electrode and a drain electrode on the semiconductor layer, and a protective layer on the source electrode and the drain electrode.

Herein, the semiconductor layer includes an active layer on the gate insulating layer, and an ohmic contact layer on the active layer.

Herein, the active layer is undoped, and the ohmic contact layer is doped.

Herein, the semiconductor layer, the source electrode, and the drain electrode are formed with the same mask.

Herein, the semiconductor layer, the source electrode, and the drain electrode are formed with different masks.

In another aspect of the present invention, a liquid crystal display device includes a plurality of data lines in a first direction, a plurality of gate lines in a second direction to cross the data lines, a plurality of first liquid crystal cells on a first side with respect to the data lines, a plurality of second liquid crystal cells on a second side with respect to the data lines, a first switching part having a first thin film transistor and a second thin film transistor to apply a video signal supplied to the data lines to the first liquid crystal cell, and a second switching part having a third thin film transistor and a fourth thin film transistor to apply a video signal supplied from the data lines to the second liquid crystal cell, and wherein the first switching part and the second switching part are symmetric in configurations except for connections to gates of the second and fourth thin film transistors.

Herein, the first, and second thin film transistors have gate terminals connected to the $i^{th}$ gate line, wherein i is a natural number.

Herein, the second thin film transistor has a second gate terminal connected to the $(i+1)^{th}$ gate line, and the fourth thin film transistor has a fourth gate terminal connected to the $(i-2)^{th}$ gate line.

Herein, the first thin film transistor has a first source terminal connected to the data lines and a first drain terminal connected to a second source terminal of the second thin film transistor, and a second drain terminal of the second thin film transistor is connected to the first liquid crystal cells.

Herein, the third thin film transistor has a third source terminal connected to the data lines and a third drain terminal connected to a fourth source terminal of the fourth thin film transistor, and a fourth drain terminal of the fourth thin film transistor is connected to the second liquid crystal cells.

Herein, the first liquid crystal cells and the first switching part are formed in odd-numbered vertical lines, and the second liquid crystal cells and the second switching part are formed in even-numbered vertical lines.

Herein, the second liquid crystal cells and the second switching part are formed in odd-numbered vertical lines, and the first liquid crystal cells and the first switching part are formed in even-numbered vertical lines.

Herein, each of the first to fourth thin film transistors includes a gate electrode on a substrate, a gate insulating layer on the gate electrode, a semiconductor layer on the gate insulating layer, a source electrode and a drain electrode on the semiconductor layer, and a protective layer on the source electrode including the drain electrode.

Herein, the semiconductor layer includes an active layer on the gate insulating layer, and an ohmic contact layer on the active layer.

Herein, the active layer is undoped, and the ohmic contact layer is doped.

Herein, the semiconductor layer, the source electrode, and the drain electrode are formed with the same mask.

Herein, the semiconductor layer, the source electrode, and the drain electrode are formed with different masks.

In another aspect of the present invention, a liquid crystal display device includes a plurality of data lines in a first direction, a plurality of gate lines in a second direction to cross the data lines, a plurality of first liquid crystal cells on a first side with respect to the data lines, a plurality of second liquid crystal cells on a second side with respect to the data lines, a first switching part in each first liquid crystal cell and controlled by a current gate line and a next gate line, and a second switching part in each second liquid crystal cell and controlled by the current gate line and a previous gate line, and wherein the first switching part and the second switching part are alternately arranged with respect to the data lines.

Herein, the first liquid crystal cells and the first switching part are located in odd-numbered vertical lines of even-numbered horizontal lines, and the second liquid crystal cells and the second switching part are located in even-numbered vertical lines of even-numbered horizontal lines.

Herein, the first liquid crystal cells and the first switching part are located in even-numbered vertical lines of odd-numbered horizontal lines, and the second liquid crystal cells and the second switching part are located in odd-numbered vertical lines of odd-numbered horizontal lines.

Herein, the first liquid crystal cells and the first switching part are located in odd-numbered vertical lines of odd-numbered horizontal lines, and the second liquid crystal cells and the second switching part are located in even-numbered vertical lines of odd-numbered horizontal lines.

Herein, the first liquid crystal cells and the first switching part are located in even-numbered vertical lines of even-numbered horizontal lines, and the second liquid crystal cells and the second switching part are located in odd-numbered vertical lines of even-numbered horizontal lines.

In another aspect of the-present invention, a driving apparatus for a liquid crystal display device includes a data driver applying a video signal to data lines, and a gate driver sequentially applying a first gate signal, a second gate signal, and a third gate signal to each gate line.

Herein, the first gate signal and the third gate signal have the same width.

Herein, the second gate signal has a width wider than those of the first gate signal and the third gate signal.

Herein, the first gate signal has a first width, the third gate signal has a third width, and the second gate signal has a second width, wherein the second width is the same as the sum of the first width and the third width.

Herein, the second gate signal applied to the $i^{th}$ gate line overlaps the first gate signal applied to the $(i+1)^{th}$ gate line and the third gate signal applied to the $(i-2)^{th}$ gate line.

Herein, the third gate signal overlaps the second gate signal after the first gate signal overlaps the second gate signal.

In a further aspect of the present invention, a method of driving a liquid crystal display device includes applying a video signal to a first liquid crystal cell when a gate signal is applied to a current gate line and a next gate line, and applying the video signal to a second liquid crystal cell when the gate signal is applied to the current gate line and a previous gate line.

In the method, the first liquid crystal cell located in the $i^{th}$ horizontal line receives the video signal when the gate signal is applied to the $i^{th}$ gate line and the $(i+1)^{th}$ gate line, wherein i is a natural number.

In the method, the second liquid crystal cell located in the $i^{th}$ horizontal line receives the video signal when the gate signal is applied to the $i^{th}$ gate line and the $(i-2)^{th}$ gate line, wherein i is a natural number.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention.

In the drawings.

DETAILED DESCRIPTION OF THE ILLUSTRATED EMBODIMENTS

Reference will now be made in detail to the illustrated embodiments of the present invention, examples of which are illustrated in the accompanying drawings. Wherever possible, the same reference numbers will be used throughout the drawings to refer to the same or like parts.

Figure 2:
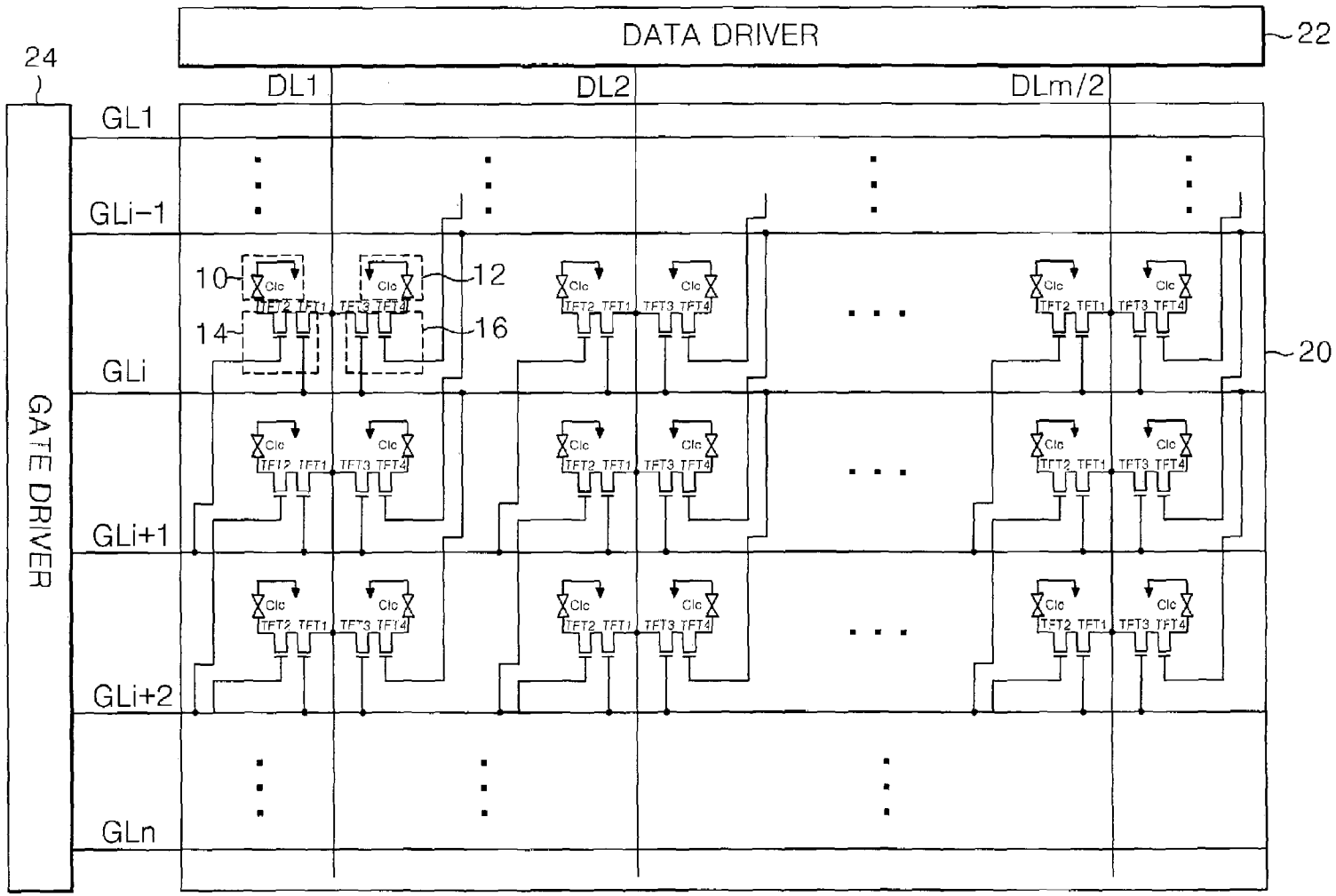
FIG. 2 illustrates a liquid crystal display device according to a first embodiment of the present invention.

FIG. 2 illustrates a liquid crystal display device according to a first embodiment of the present invention.

Referring to FIG. 2, the liquid crystal display device according to the first embodiment of the present invention includes a liquid crystal display panel 20, a data driver 22 driving data lines DL1 to DLm/2 of the liquid crystal display panel 20, and a gate driver 24 driving gate lines GL1 to GLn of the liquid crystal display panel 20.

More specifically, the liquid crystal display panel 20 includes a plurality of first liquid crystal cells 10 and a plurality of second liquid crystal cells 12 formed at the intersections of the gate lines GL1 to GLn and the data lines DL1 to DLm/2, a plurality of first switching parts 14 driving the first liquid crystal cells. 10 and a plurality of second switching parts 16 driving the second liquid crystal cells 12. The first liquid crystal cells 10 and the second liquid crystal cells 12 are composed of a pixel electrode connected to the first switching part 14 and the second switching part 16, respectively, and a common electrode facing into each other with the liquid crystal therebetween, thus they can be expressed equivalent to a liquid crystal capacitor Clc. Herein, the first and second liquid crystal cells 10 and 12 include storage capacitors (not shown) connected to the previous gate line in order to sustain the data voltage charged in the liquid crystal capacitor Clc until the next data voltage is charged.

The first liquid crystal cells 10 and the first switching parts 14 are formed on the left side of the data line DL (i.e., odd-numbered vertical lines). The second liquid crystal cells 12 and the second switching parts 16 are formed on the right side of the data line DL (i.e., even-numbered vertical lines). In other words, the first liquid crystal cells 10 and the,second liquid crystal cells 12 are formed on the left and right sides of one data line DL. The first liquid crystal cells 10 and the second liquid crystal cells 12 are supplied with video signals from the data line DL located adjacent thereto. In other words, in the liquid crystal display device according to the present invention, the number of data lines DL are reduced to a half as many as in the related art liquid crystal display device shown in FIG. 1.

Figure 4:
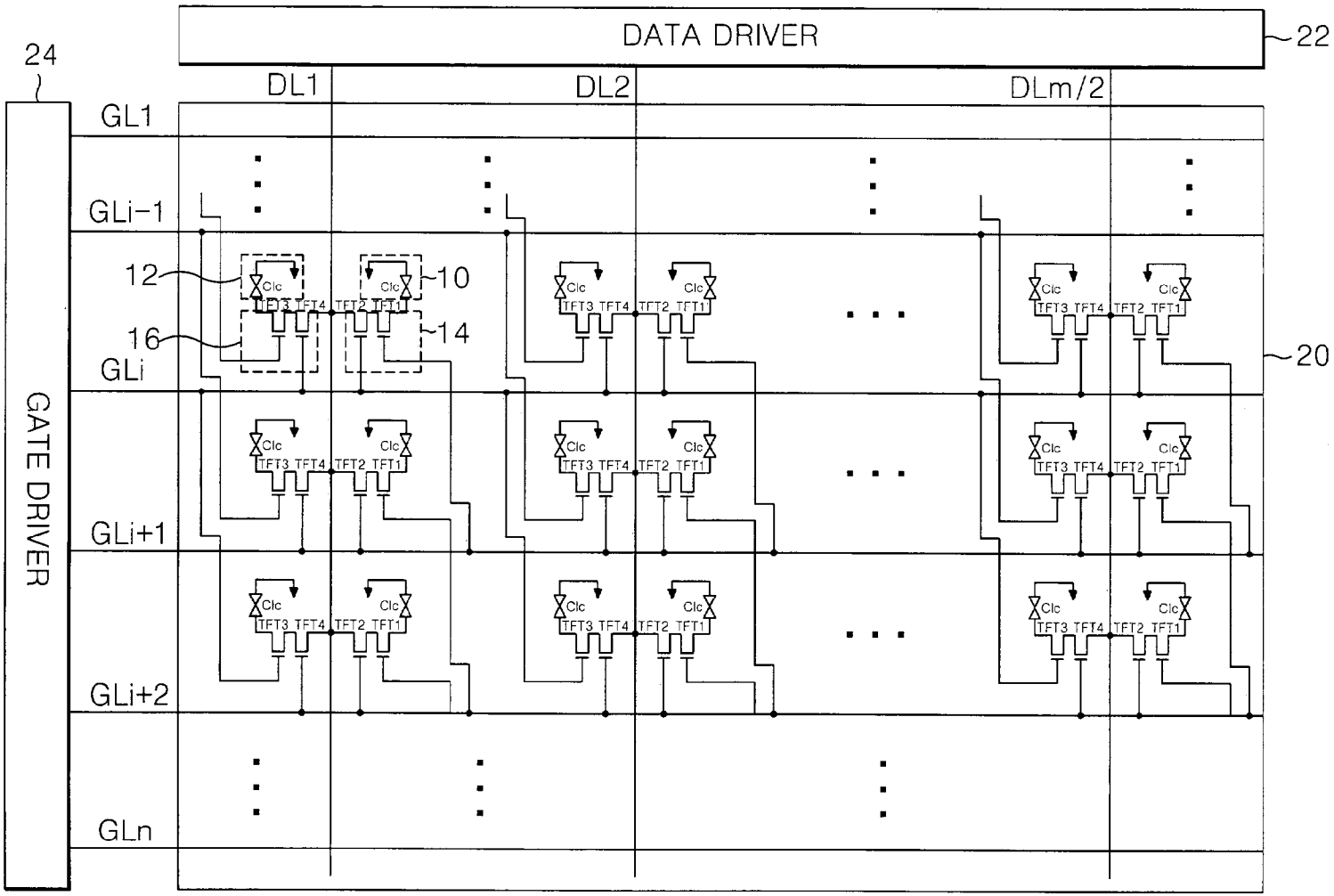
FIG. 4 illustrates a liquid crystal display device according to another embodiment of FIG. 2.

On the other hand, the location of the first liquid crystal cells 10 and the second liquid crystal cells 12 can be changed, as shown in FIG. 4. For example, the first liquid crystal cells 10 and the first switching parts 14 are formed on the right side of the data line DL, and the second liquid crystal cells 12 and the second switching parts 16 are formed on the left side of the data line DL. In other words, the first liquid crystal cells 10 and the first switching parts 14 are formed in the even-numbered vertical lines, while the second liquid crystal cells 12 and the second switching parts 16 are formed in the odd-numbered-vertical lines.

The first switching part 14 driving the first liquid crystal cell 10 includes a first thin film transistor TFT1 and a second thin film transistor TFT2. The gate terminal of the first thin film transistor TFT1 is connected to the $i^{th}$ (wherein i is a natural number) gate line GLi, and the source terminal is connected to the adjacent data line DL. The gate terminal of the second thin-film transistor TFT2 is connected to the $(i+1)^{th}$ gate line GLi+1, and the source terminal of the second thin film transistor TFT2 is connected to the drain terminal of the first thin film transistor TFT1. The drain terminal of the second thin film transistor TFT2 is connected to the first liquid crystal cell 10. In this way, the first switching part 14 applies video signals to the first liquid crystal cell 10 when driving signals are supplied to the current gate line GLi and the next gate line GLi+1.

The second switching part 16 driving the second liquid crystal cell 12 includes a third thin film transistor TFT3 and a fourth thin film transistor TFT4. The gate terminal of the third thin film transistor TFT3 is connected to the $i^{th}$ (wherein i is a natural number) gate line GLi, while the source terminal is connected to the adjacent data line DL. The gate terminal of the fourth thin film transistor TFT4 is connected to the $(i-2)^{th}$ gate line GLi−2, and the source terminal is connected to the drain terminal of the third thin film transistor TFT3. The drain terminal of the fourth thin film transistor TFT4 is connected to the second liquid crystal cell 12. In this way, the second switching part 16 applies video signals to the second liquid crystal cell 12 when driving signals are applied to the current gate line GLi and the previous gate line GL1−2.

In this way, the first switching part 14 and the second switching part 16 have the structure of the same type (i.e., a mirror image) except for the gate terminal of the second thin film transistor TFT2 and the fourth thin film transistor TFT4.

Figure 3:
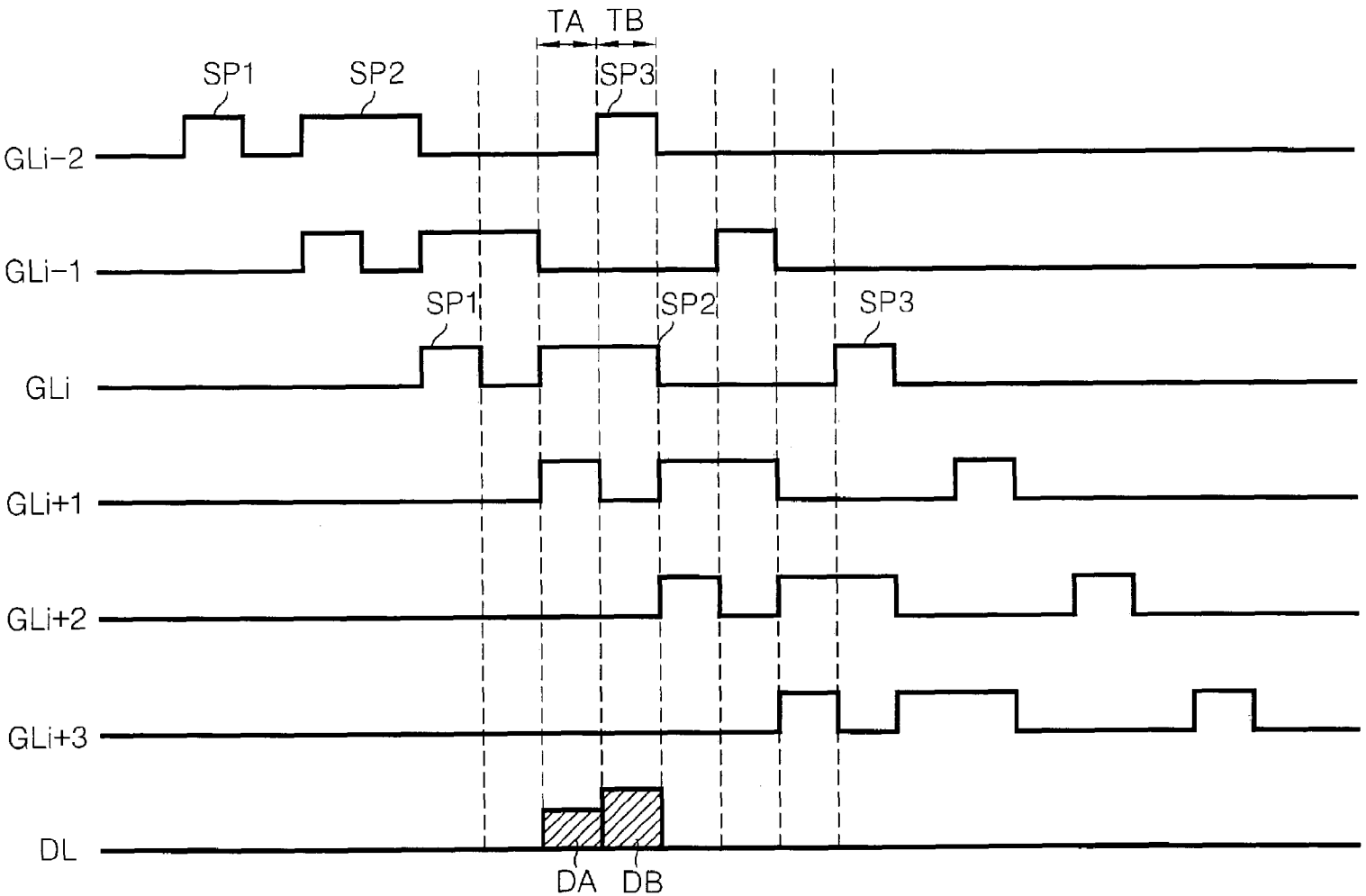
FIG. 3 is a waveform diagram illustrating gate signals applied to the gate lines by the gate driver in FIG. 2.

The gate driver 24, as shown in FIG. 3, applies a first gate signal SP1, a second gate signal SP2, and a third gate signal SP3 to each of the gate lines GL1 to GLn in accordance with control signals applied from the timing controller (not shown). Herein, the first gate signal SP1 and the third gate signal SP3 have the same width. The second gate signal SP2 is set to have a width wider than those of the first gate signal SP1 and the third-gate signal SP3. Alternatively, the width of the second gate signal SP2 is the same as the sum of the width of the first gate signal SP1 and the width of the third gate signal SP3.

Figure 1:
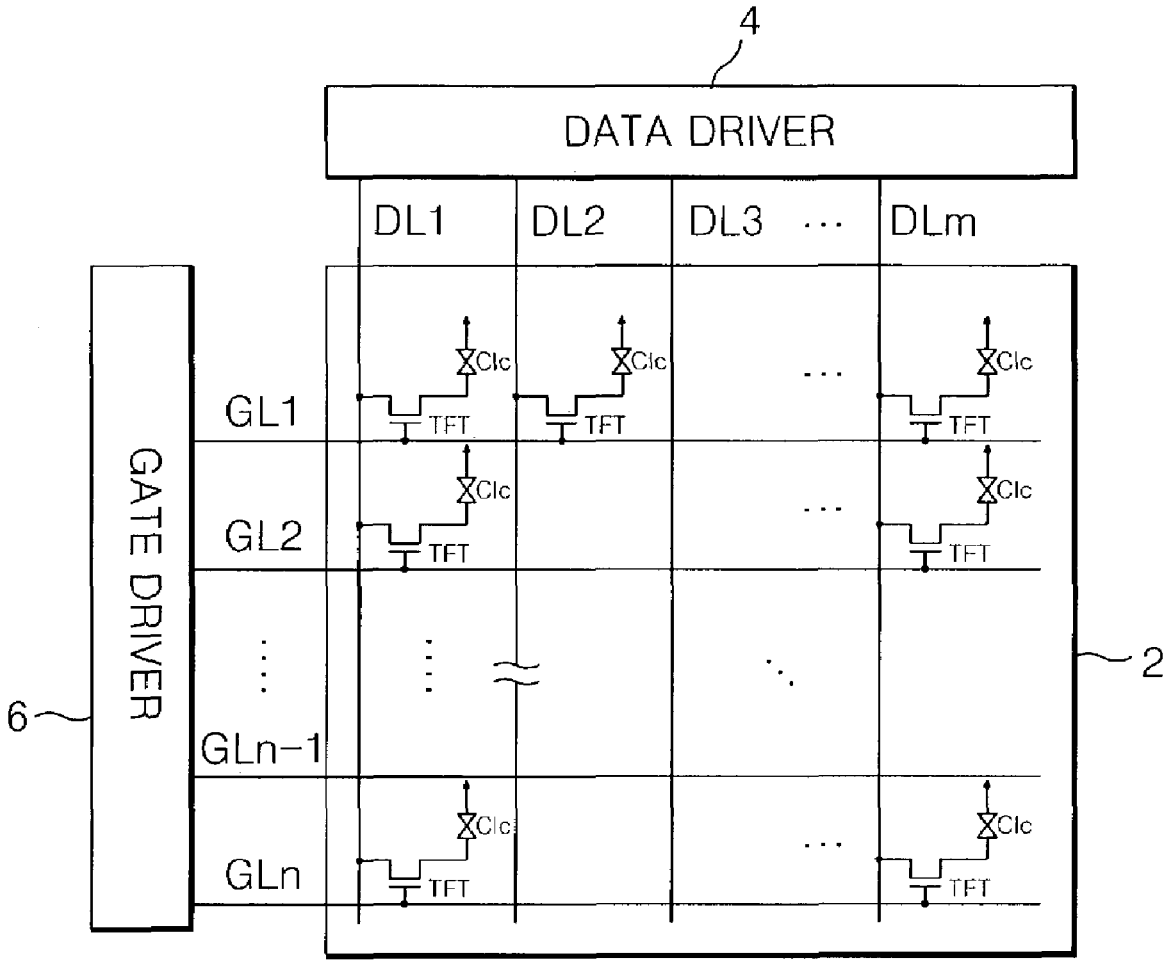
FIG. 1 RELATED ART
FIG. 1 illustrates a related art liquid crystal display device.

The data driver 22 converts data R, G, and B supplied from the timing controller into video signals as analog signals and applies to the data lines DL1 to DLm/2. Since the number of data lines DL1 to DLm/2 is decreased to a half as compared to the related art liquid crystal display device, as shown in FIG. 1, the number of data driver IC's, which is included in the data driver 22, is also decreased to a half.

More specifically, the gate driver 24 sequentially applies the first to third gate signals. SP1 and SP3 to each of the gate lines GL. The second gate signal SP2 applied to the $i^{th}$ gate line GLi overlaps the first gate signal SP1 applied to the $(i+1)^{th}$ gate line GLi+1 for a first period TA. Also, the second gate signal SP2 applied to the $i^{th}$ gate line GLi overlaps the third gate signal SP3 applied to the $(i-2)^{th}$ gate line GLi−2 for a second period TB.

In other words, the first gate signal SP1 applied to the current gate line GLi overlaps the second gate signal SP2 applied to the previous gate line GLi−1 for a first period TA. The third gate signal SP3 applied to the current gate line GLi overlaps the second gate signal SP2 applied to the next gate line GLi+2 for the second period TB.

To describe in more detail a process that a video signal is applied to the liquid crystal cells 10 and 12, the second gate signal SP2 applied to the $i^{th}$ gate line GLi for the first period TA and the second period TB is applied to the gate terminal of the first and third thin film transistors TFT1 and TFT3. Accordingly, the firsthand third thin film transistor TFT1 and TFT3 remain at a turn-on state for the period TA+TB when the second gate signal SP2 is applied.

On the other hand, the first gate signal SP1 is applied to the $(i+1)^{th}$ gate line for the first period TA, and the first gate signal SP1 is applied to the gate terminal of the second thin film transistor TFT2 to turn on the second thin film transistor TFT2. When the second thin film transistor TFT2 is turned on, the video signal DA applied to the data line DL is applied to the first liquid crystal cell 10 through the first and second thin film transistors TFT1 and TFT2. In other words, the first liquid crystal cell 10 located along with the $i^{th}$ horizontal line receives the video signal DA when the second gate signal SP2 is applied to the $i^{th}$ gate line GLi and the first gate signal SP1 is applied to the $(i+1)^{th}$ gate line GLi+1.

For the second period TB after the first period TA, the third gate signal SP3 is applied to the $(i-2)^{th}$ gate line, and the third gate signal SP3 turns on the fourth thin film transistor TFT4. When the fourth transistor TFT4 is turned on, the video signal DB applied to the data line DL is applied to the second liquid crystal cell 12 through the third and fourth thin film transistors TFT3 and TFT4. In other words, the second liquid crystal cell 12 located along with the $i^{th}$ horizontal line receives the video signal DB when the second gate signal SP2 is applied to the $i^{th}$ gate line GLi and the third gate signal SP3 is applied to the $(i-2)^{th}$ gate line GLi−2.

Figure 5:
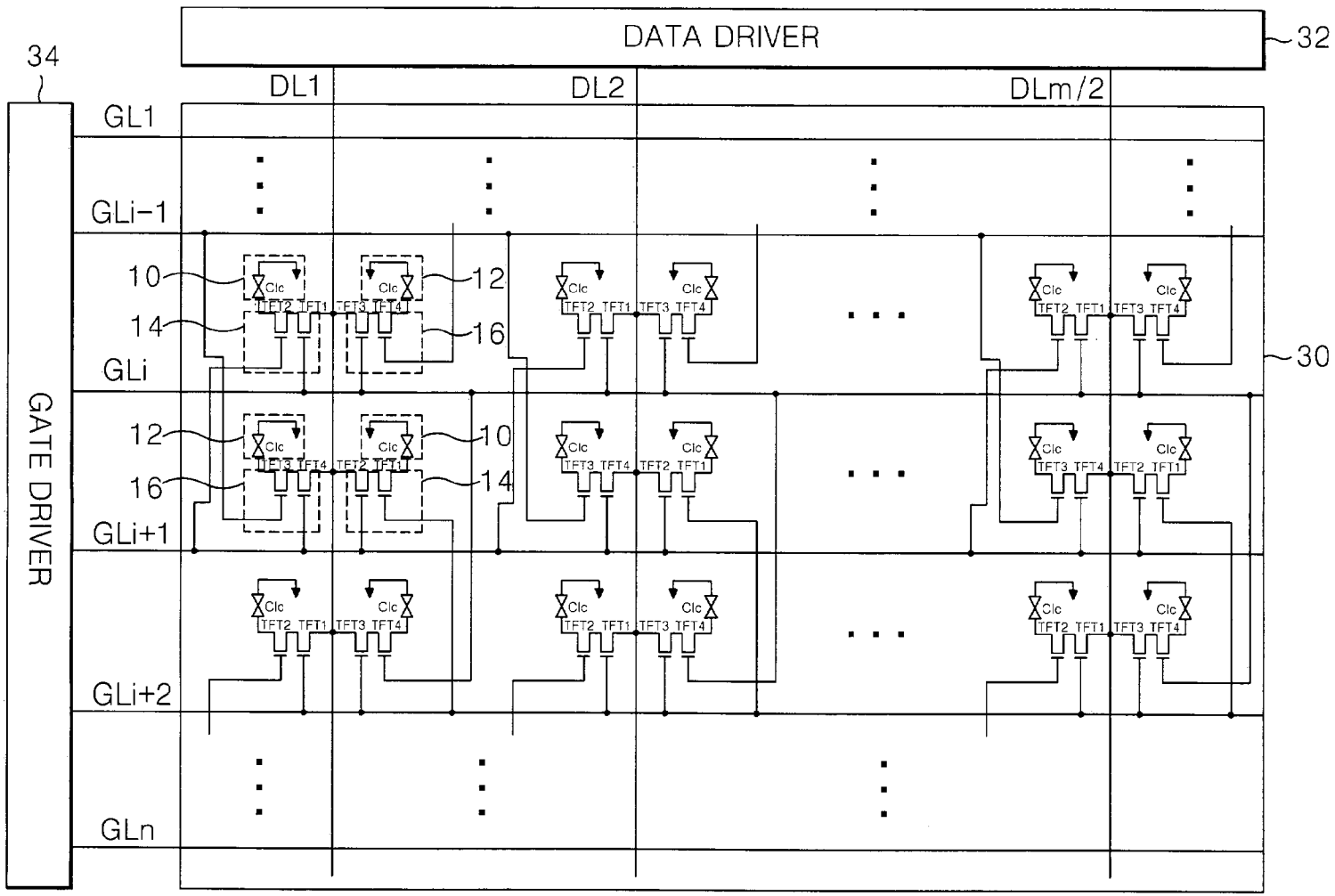
FIG. 5 illustrates a liquid crystal display device according to a second embodiment of the present invention.

FIG. 5 illustrates a liquid crystal display device according to a second embodiment of the present invention. In this embodiment, the locations for the liquid crystal cells 10 and 12 and the switching parts 14 and 16 are changed, and their structure and function are the same as the embodiment of the present invention shown in FIG. 2.

Referring to FIG. 5, the liquid crystal display device according to the second embodiment of the present invention includes a liquid crystal display panel 30, a data driver 32 driving a plurality of data lines DL1 to DLm/2 of the liquid crystal display panel 30, and,a gate driver 34 driving a plurality of gate lines GL1 to GLn of the liquid crystal display panel 30.

More specifically, the liquid crystal display panel 30 includes a plurality of first liquid crystal cells 10 and a plurality of second liquid crystal cells. 12 formed at the intersections of the gate lines GL1 to GLn+1 and the data lines DL1 to DLm/2, a plurality of first switching parts 14 driving the first liquid crystal cells. 10 and a plurality of second switching parts 16 driving the second liquid crystal cells 12. In this embodiment of the present invention, the first liquid crystal cells 10, the first switching parts 14, the second liquid crystal cells 12, and the second switching parts 16 are arranged alternatively with respect to the data line DL.

Herein, in the odd-numbered horizontal line, the first liquid crystal cells 10 and the first switching parts 14, as shown in FIG. 5, are located in the odd-numbered vertical line, and the second liquid crystal cells 12 and the second switching parts 16 are located in the even-numbered vertical line. In the even-numbered horizontal line, the first liquid crystal cells 10 and the first switching parts 14 are located in the even-numbered vertical line, and the second liquid crystal cells 12 and the second switching parts 16 are located in the odd-numbered vertical line.

Figure 6:
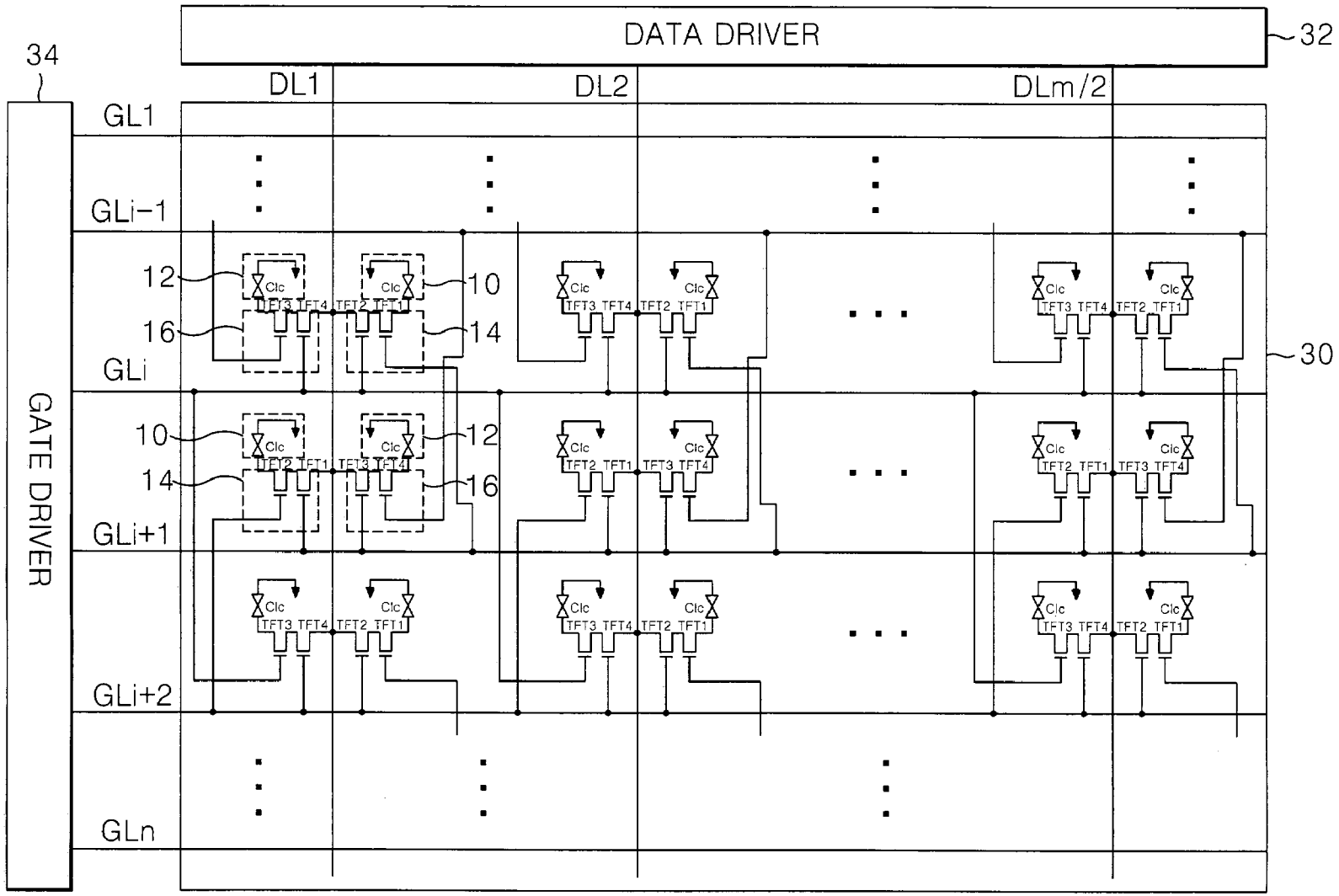
FIG. 6 illustrates a liquid crystal display device according to another embodiment of FIG. 5.

Further, in another embodiment of the present invention, in the odd-numbered horizontal line, as shown in FIG. 6, the first liquid crystal cells 10 and the first switching parts 14 are located in the even-numbered vertical line, and the second liquid crystal cells 12 and the second switching parts 16 are located in the odd-numbered vertical line. In the even-numbered horizontal line, the first liquid crystal cells 10 and the first switching parts 14 are located in the odd-numbered vertical line, and the second liquid crystal cells 12 and the second switching parts 16, are located in the even-numbered vertical line.

In this way, the first-liquid crystal cells 10 and the second liquid crystal cells 12 arranged alternatively with respect to the data line DL receive the video signal from the adjacent data line DL (i.e., the base data line). Therefore, in the liquid crystal display according to this embodiment of the present invention, the number of data line DL is reduced to a half as compared to the related art liquid crystal display device, as shown in FIG. 1.

The first switching part 14 driving the first liquid crystal cell 10 includes a first thin film transistor TFT1 and a second thin film transistor TFT2. The gate terminal of the first thin film transistor TFT1 is connected to the $i^{th}$ gate line GLi, and the source terminal is connected to the adjacent data line. The gate terminal of the second thin film transistor TFT2 is connected to the $(i+1)^{th}$ gate line GLi+1, and the source terminal is connected to the drain terminal of the first thin film transistor TFT1. The drain terminal of the second thin film transistor TFT2 is connected to the first liquid crystal cell 10. In this way, the first switching part 14 applies video signals to the first liquid crystal cell 10 when driving signals are supplied to the current gate line GLi and the next gate line GLi+1.

The second switching part 16 driving the second liquid crystal cell 12 includes a third thin film transistor TFT3 and a fourth thin film transistor TFT4. The gate terminal of the third thin film transistor TFT3, is connected-to the $i^{th}$ (wherein i is a natural number) gate line GLi, and the source terminal is connected to the adjacent data line DL. The gate terminal of the fourth thin film transistor TFT4 is connected $(i-2)^{th}$ gate line GLi−2, while the source terminal is connected to the drain terminal of the third thin film transistor TFT3. The drain terminal of the fourth thin film transistor TFT4 is connected to the second liquid crystal cell 12. The second switching part 16 applies the video signal to the second liquid crystal cell 16 when the driving signals are applied to the current gate line GLi and the previous gate line GLi−2.

In this way, the first switching part 14 and the second switching part 16 have the structure of the same type (i.e., a mirror image) except for the gate terminal of the second thin film transistor TFT2 and the fourth thin film transistor TFT4.

The gate driver 34, as shown in FIG. 3, applies a first gate signal SP1, a second gate signal SP2, and a third gate signal SP3 to each of the gate lines GLi to GLn in accordance with control signals applied from the timing controller (not shown). Herein, the first gate signal SP1 and the third gate signal SP3 have the same width. And, the second gate signal SP2 is set to have its width wider than those of the first gate signal SP2 and the third gate signal SP3. Alternatively, the width of the second gate signal SP2 is the same as the sum of the width of the first gate signal SP1 and the width of the third gate signal SP3.

The data driver 32 converts data R, G, and B supplied from the timing controller into video signals as analog signals and applies to the data lines DL1 to DLm/2. Since the number of data lines DL1 to DLm/2 is decreased to a half as compared to the liquid crystal display device of the related art, as shown in FIG. 1, the number of data driver IC's, which is included in the data driver 32, is also decreased to a half.

More specifically, in describing the driving process of the liquid crystal display device according to the present invention, the gate driver 34 sequentially applies the first to third gate signals SP1 and SP3 to each of the gate lines GL. The second gate signal SP2 applied to the $i^{th}$ gate line GLi overlaps the first gate signal SP1 applied to the $(i+1)^{th}$ gate line GLi+1 for a first period TA. Also, the second gate signal SP2 applied to the $i^{th}$ gate line GLi overlaps the third gate signal SP3 applied to the $(i-2)^{th}$ gate line GLi−2 for a second period TB.

In other words, the first gate signal SP1 applied to the current gate line GLi overlaps the second gate signal SP2 applied to the previous gate line GLi−1 for a first period TA, and the third gate signal SP3 applied to the current gate line GLi overlaps the second gate signal SP2 applied to the next gate line GLi+2 for the second period TB.

In describing a process that a video signal is applied to the liquid crystal cells 10 and 12, the second gate signal SP2 applied to the $i^{th}$ gate line GLi for the first period TA and the second period TB is applied to the gate terminal of the first and third thin film transistors TFT1 and TFT3. Accordingly, the first and third thin film transistor TFT1 and TFT3 remain at a turn-on state for the period TA+TB when the second gate signal SP2 is applied.

On the other hand, the first gate signal SP1 is applied to the $(i+1)^{th}$ gate line for the first period TA, and the first gate signal SP1 is applied to the gate terminal of the second thin film transistor TFT2 to turn on the second thin film transistor. When the second thin film transistor TFT2 is turned on, the video signal applied to the data line DL is applied to the first liquid crystal cell 10 through the first and second thin film transistors TFT1 and TFT2. In other words, the first liquid crystal cell 10 located in the $i^{th}$ horizontal line receives the video signal when the second gate signal SP2 is applied to the $i^{th}$ gate line GLi and the first gate signal SP1 is applied to the $(i+1)^{th}$ gate line GLi+1.

For the second period TB after the first period TA, the third gate signal SP3 is applied to the $(i-2)^{th}$ gate line, and the third gate signal SP3 turn on the fourth thin film transistor TFT4. When the fourth transistor TFT4 is turned on, the video signal applied to the data line DL is applied to the second liquid crystal cell 12 through the third and fourth thin film transistors TFT3 and TFT4. In other words, the second liquid crystal cell 12 located in the $i^{th}$ horizontal line receives the video signal when the second gate signal SP2 is applied to the $i^{th}$ gate line GLi and the third gate signal SP3 is applied to the $(i-2)^{th}$ gate line. GLi−2.

On the other hand, in another embodiment of the present invention, since the first liquid crystal cell 10 and the second liquid crystal cell 12 are alternately arranged in the horizontal lines, an image of uniform picture quality can be displayed even if the first liquid crystal cell 10 and the second liquid crystal cell 12 are not charged with a uniform voltage. For example, even if the first liquid crystal cell 10 is charged with a voltage higher than a desired voltage and the second liquid crystal cell 12 are charged with a voltage lower than a desired voltage, since the first liquid crystal cell 10 and the second liquid crystal cell 12 are alternatively arranged in the horizontal lines, the voltage differences are set-off by the horizontal line, thereby displaying an image of uniform picture quality.

Figure 7:
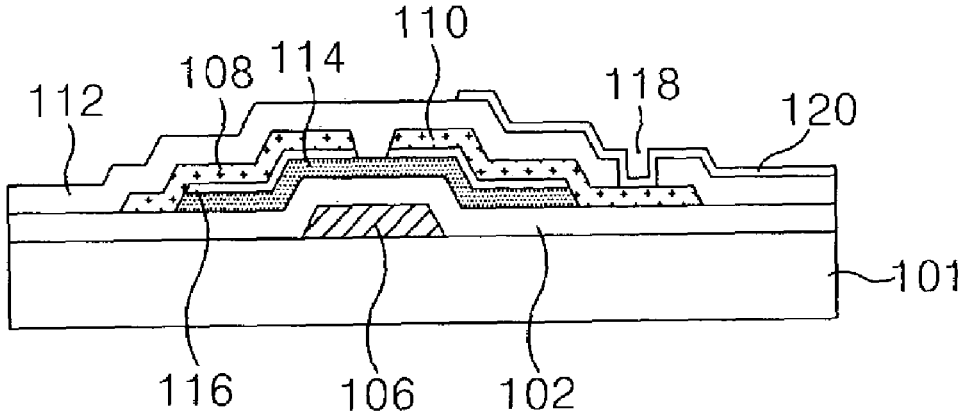
FIG. 7 is a cross-sectional view illustrating a structure of a thin film transistor according to the present invention.

Each of thin film transistors TFTs included in the present invention may be formed as shown in FIG. 7.

Referring to FIG. 7, a thin film transistor TFT includes a gate electrode 106 formed on a lower substrate 101, a source electrode 108 and a drain electrode 110 formed in layers different from the gate electrode 106. Herein, the drain electrode 110 is formed to be connected with a pixel electrode 120 through a drain contact hole 118. The drain electrode 110 is connected to the pixel electrode 120 or the adjacent thin film transistor TFT.

There are an active layer 114 and an ohmic contact layer 116 (collectively called semiconductor layers) deposited to form a conduction channel between the gate electrode 106, the source electrode 108 and the drain electrode 110. Herein, the active layer 114 is formed between the active layer 114 and the source electrode 108, and the ohmic layer 116 is formed between the active layer 114 and the drain electrode 110. The active layer 114 is formed of amorphous silicon without doping with impurities, and the ohmic contact layer 116 is formed of amorphous silicon with n-type or p-type dopants. When a voltage is applied to the gate electrode 106, the active layer 114 and the ohmic contact layer 116 apply the voltage supplied to the source electrode 108 to the drain electrode 110. There is a gate insulating layer 112 formed between the gate electrode 106 and the semiconductor layers 114 and 116. And, there is a protective layer 112 formed on the source electrode 108 and the drain electrode 110.

The source electrode 108 and the drain electrode 110 of the thin film transistor TFT included in the present invention are formed with a mask different from the semiconductor layers 114 and 116. Accordingly, the source electrode 108 and the drain electrode 110 have a pattern different from the semiconductor layers 114 and.116.

Figure 8:
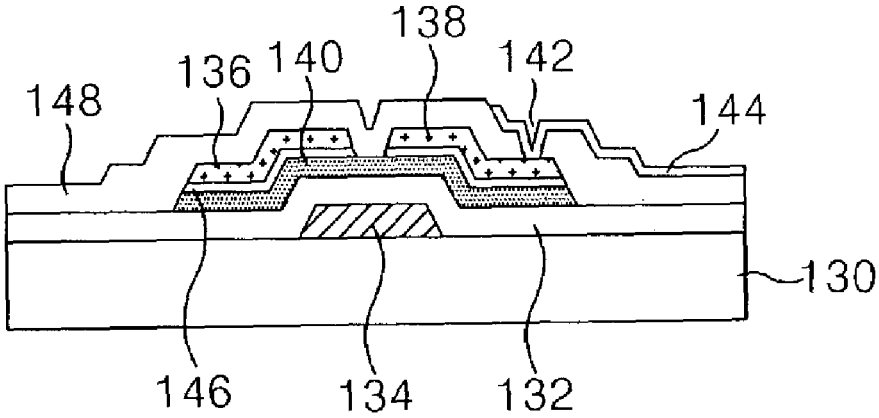
FIG. 8 is a cross-sectional view illustrating another structure of the thin film transistor according to the present invention.

FIG. 8 is a cross-sectional view illustrating a structure of a thin film transistor according to another embodiment of the present invention.

Referring to FIG. 8, the thin film transistor TFT according to the present invention includes a gate electrode 134 formed on a lower substrate 130, a source electrode 136 and a drain electrode 138 formed in a layer different from the gate electrode 134. Herein, the drain electrode 138 is formed to be connected with a pixel electrode 144 through a drain contact hole 142. The drain electrode 138 is connected to the pixel electrode 144 or the adjacent thin film transistor TFT.

There are an active layer 140 and an ohmic contact layer 146 (collectively called semiconductor layers) deposited to form a conduction channel between the gate electrode 134, the source electrode 136 and the drain electrode 138. Herein, the active layer 140 is formed between the active layer 140 and the source electrode 136, and the ohmic contact layer 146 is formed between the active layer 140 and the drain electrode 138. The active layer 104 is formed of amorphous silicon without dopants, and the ohmic contact layer 146 is formed of amorphous silicon with an n-type or p-type dopant. When a voltage is applied to the gate electrode 134, these semiconductor layers 140 and 146 apply the voltage supplied to the source electrode 136 to the drain electrode 138. There is a gate insulating layer 132 formed between the gate electrode 134 and the semiconductor layers 140 and 146. And, there is a protective layer 148 formed on the source electrode 136 and the drain electrode 138. The source electrode 136 and the drain electrode 138 of the thin film transistor TFT included in the present invention are formed with the same mask as the semiconductor layers 140 and 146.

As described above, according to the liquid crystal display device and the driving method thereof in the present invention, since the first and second liquid crystal cells located adjacent to the left and right sides of one data line are driven, the number of data lines is reduced to about a half. Accordingly, the number of data driver IC's that apply the driving signal to the data line is also reduced to about a half, thereby reducing its fabricating cost. Further, in the present invention, since a uniform voltage is applied to the thin film transistors included in the first switching part and the second switching part, an image of the uniform picture can be displayed. Furthermore, the first liquid crystal cells and the second liquid crystal cells are alternatively arranged in the horizontal lines, so that it is capable of displaying the image of the uniform-picture.

It will be apparent to those skilled in the art that various modifications and variations can be made in the apparatus and method of driving a liquid crystal display device of the present invention without departing from the spirit or scope of the inventions. Thus, it is intended that the present invention covers the modifications and variations of this invention provided they come within the scope of the appended claims and their equivalents.

What is claimed is:

1. A liquid crystal display device, comprising:

a plurality of data lines in a first direction;

a plurality of gate lines in a second direction to cross the data lines;

a plurality of first liquid crystal cells on a first side with respect to the data lines;

a plurality of second liquid crystal cells on a second side with respect to the data lines;

a first switching part in each first liquid crystal cell and controlled by a current gate line and a next gate line;

a second switching part in each second liquid crystal cell and controlled by the current gate line and a previous gate line;

a first ratio that is the ratio of the number of data lines to the gate lines; and a second ratio that is the ratio of an aspect ratio of the liquid crystal display and the first ratio;

wherein the second ratio is approximately 2.

2. The liquid crystal display device according to claim 1, wherein the first switching part applies a video signal supplied to the data lines to the first liquid crystal cell when a gate signal is applied to the current gate line and the next gate line.

3. The liquid crystal display device according to claim 1, wherein the second switching part applies a video signal supplied to the data lines to the second liquid crystal cell when a gate signal is applied to the current gate line and the previous gate line.

4. The liquid crystal display device according to claim 1, wherein the first switching part located in the $i^{th}$ horizontal line applies a video signal supplied to the data lines to the first liquid crystal cell when a gate signal is applied to the $i^{th}$ gate line and $(i+1)^{th}$ gate line, wherein i is a natural number.

5. The liquid crystal display device according to claim 1, wherein the second switching part located in the $i^{th}$ horizontal line applies a video signal supplied to the data lines to the second liquid crystal cell when a gate signal is applied to the $i^{th}$ gate line and $(i-2)^{th}$ gate line, wherein i is a natural number.

6. The liquid crystal display device according to claim 1, wherein the first liquid crystal cells and the first switching part are located on the left side of the data lines.

7. The liquid crystal display device according to claim 6, wherein the second liquid crystal cells and the second switching part are located on the right side of the data lines.

8. The liquid crystal display device according to claim 1, wherein the first liquid crystal cells and the first switching part are located on the right side of the data lines.

9. The liquid crystal display device according to claim 1, wherein the second liquid crystal cells and the second switching part are located on the left side of the data lines.

10. The liquid crystal display device according to claim 1, wherein the first switching part includes:

a first thin film transistor having a first gate terminal connected to the current gate line and a first source terminal connected to the data lines; and a second thin film transistor having a second gate terminal connected to the next gate line, a second source terminal connected to a first drain terminal of the first thin film transistor, and a second drain terminal connected to the first liquid crystal cells.

11. The liquid crystal display device according to claim 10, wherein the current gate line is the $i^{th}$ gate line, and the next gate line is the $(i+1)^{th}$ gate line, wherein i is a natural number.

12. The liquid crystal display device according to claim 10, wherein the second switching part includes:

a third thin film transistor having a third gate terminal connected to the current gate line and a third source terminal connected to the data lines; and a fourth thin film transistor having a fourth gate terminal connected to the previous gate line, a fourth source terminal connected to a third drain terminal of the third thin film transistor and a fourth drain terminal connected to the second liquid crystal cell.

13. The liquid crystal display device according to claim 12, wherein the current gate line is the $i^{th}$ gate line, and the previous gate line is the $(i-2)^{th}$ gate line, wherein i is a natural number.

14. The liquid crystal display device according to claim 12, wherein each of the first to fourth thin film transistors includes:

a gate electrode on a substrate;

a gate insulating layer on the gate electrode;

a semiconductor layer on the gate insulating layer;

a source electrode and a drain electrode on the semiconductor layer; and a protective layer on the source electrode and the drain electrode.

15. The liquid crystal display device according to claim 14, wherein the semiconductor layer includes:

an active layer on the gate insulating layer; and an ohmic contact layer on the active layer.

16. The liquid crystal display device according to claim 15, wherein the active layer is undoped.

17. The liquid crystal display device according to claim 15, wherein the ohmic contact layer is doped.

18. The liquid crystal display device according to claim 14, wherein the semiconductor layer, the source electrode, and the drain electrode are formed with the same mask.

19. The liquid crystal display device according to claim 14, wherein the semiconductor layer, the source electrode, and the drain electrode are formed with different masks.

20. A liquid crystal display device, comprising:

a plurality of data lines in a first direction;

a plurality of gate lines in a second direction to cross the data lines;

a plurality of first liquid crystal cells on a first side with respect to the data lines;

a plurality of second liquid crystal cells on a second side with respect to the data lines;

a first switching part having a first thin film transistor and a second thin film transistor to apply a video signal supplied to the data lines to the first liquid crystal cell a second switching part having a third thin film transistor and a fourth thin film transistor to apply a video signal supplied to the data lines to the second liquid crystal cell;

a first ratio that is the ratio of the number of data lines to the gate lines; and a second ratio that is the ratio of an aspect ratio of the liquid crystal display and the first ratio;

wherein the second ratio is approximately 2; and wherein the first switching part and the second switching part are symmetric in configurations except for connections to gates of the second and fourth thin film transistors.

21. The liquid crystal display device according to claim 20, wherein the first and second thin film transistors have gate terminals connected to the $i^{th}$ gate line, wherein i is a natural number.

22. The liquid crystal display device according to claim 20, wherein the second thin film transistor has a second gate terminal connected to the $(i+1)^{th}$ gate line, and the fourth thin film transistor has a fourth gate terminal connected to the $(i-2)^{th}$ gate line.

23. The liquid crystal display device according to claim 20, wherein the first thin film transistor has a first source terminal connected to the data lines and a first drain terminal connected to a second source terminal of the second thin film transistor, and a second drain terminal of the second thin film transistor is connected to the first liquid crystal cells.

24. The liquid crystal display device according to claim 20, wherein the third thin film transistor has a third source terminal connected to the data lines and a third drain terminal connected to a fourth source terminal of the fourth thin film transistor, and a fourth drain terminal of the fourth thin film transistor is connected to the second liquid crystal cells.

25. The liquid crystal display device according to claim 20, wherein the first liquid crystal cells and the first switching part are formed in odd-numbered vertical lines, and the second liquid crystal cells and the second switching part are formed in even-numbered vertical lines.

26. The liquid crystal display device according to claim 20, wherein the second liquid crystal cells and the second switching part are formed in odd-numbered vertical lines, and the first liquid crystal cells and the first switching part are formed in even-numbered vertical lines.

27. The liquid crystal display device according to claim 20, wherein each of the first to fourth thin film transistors includes:

a gate electrode on a substrate;

a gate insulating layer on the gate electrode;

a semiconductor layer on the gate insulating layer;

a source electrode and a drain electrode on the semiconductor layer; and a protective layer on the source electrode including the drain electrode.

28. The liquid crystal display device according to claim 27, wherein the semiconductor layer includes:

an active layer on the gate insulating layer; and an ohmic contact layer on the active layer.

29. The liquid crystal display device according to claim 28, wherein the active layer is undoped.

30. The liquid crystal display device according to claim 28, wherein the ohmic contact layer is doped.

31. The liquid crystal display device according to claim 27, wherein the semiconductor layer, the source electrode, and the drain electrode are formed with the same mask.

32. The liquid crystal display device according to claim 27, wherein the semiconductor layer, the source electrode, and the drain electrode are formed with different masks.

33. A liquid crystal display device, comprising:

a plurality of data lines in a first direction;

a plurality of gate lines in a second direction to cross the data lines;

a plurality of first liquid crystal cells on a first side with respect to the data lines;

a plurality of second liquid crystal cells on a second side with respect to the data lines;

a first switching part formed in each first liquid crystal cell and controlled by a current gate line and a next gate line;

a second switching part formed in each second liquid crystal cell and controlled by the current gate line and a previous gate line;

a first ratio that is the ratio of the number of data lines to the gate lines; and a second ratio that is the ratio of an aspect ratio of the liquid crystal display and the first ratio;

wherein the second ratio is approximately 2; and wherein the first switching part and the second switching part are alternately arranged with respect to the data lines.

34. The liquid crystal display device according to claim 33, wherein the first liquid crystal cells and the first switching part are located in odd-numbered vertical lines of even-numbered horizontal lines, and the second liquid crystal cells and the second switching part are located in even-numbered vertical lines of even-numbered horizontal lines.

35. The liquid crystal display device according to claim 33, wherein the first liquid crystal cells and the first switching part are located in even-numbered vertical lines of odd-numbered horizontal lines, and the second liquid crystal cells and the second switching part are located in odd-numbered vertical lines of odd-numbered horizontal lines.

36. The liquid crystal display device according to claim 33, wherein the first liquid crystal cells and the first switching part are located in odd-numbered vertical lines of odd-numbered horizontal lines, and the second liquid crystal cells and the second switching part are located in even-numbered vertical lines of odd-numbered horizontal lines.

37. The liquid crystal display device according to claim 33, wherein the first liquid crystal cells and the first switching part are located in even-numbered vertical lines of even-numbered horizontal lines, and the second liquid crystal cells and the second switching part are located in odd-numbered vertical lines of even-numbered horizontal lines.

38. A driving apparatus for a liquid crystal display device, comprising:

a data driver applying a video signal to data lines; and a gate driver sequentially applying a first gate signal, a second gate signal, and a third gate signal to a first gate line and sequentially applying a fourth gate signal, a fifth gate signal, and a sixth gate signal to a second gate line that is adjacent to the first gate line, wherein the second gate signal has a width approximately twice the width of the fourth gate signal and second gate signal overlaps the fourth gate signal in time.

39. The driving apparatus according to claim 38, wherein the first gate signal and the third gate signal have the same width.

40. The driving apparatus according to claim 38, wherein the second gate signal has a width wider than those of the first gate signal and the third gate signal.

41. The driving apparatus according to claim 38, wherein the first gate signal has a first width, the third gate signal has a third width, and the second gate signal has a second width, wherein the second width is the same as the sum of the first width and the third width.

42. The driving apparatus according to claim 38, wherein the first gate line is the $i^{th}$ gate line, the second gate line is the $(i+1)^{th}$ gate line, and the second gate signal applied to the $i^{th}$ gate line overlaps a third gate signal applied to the $(i-2)^{th}$ gate line.

43. The driving apparatus according to claim 42, wherein the third gate signal applied to the $(i-2)^{th}$ gate line overlaps the second gate signal after the first gate signal overlaps the second gate signal.

44. A method of driving a liquid crystal display device, the liquid crystal display device having a plurality of liquid crystal cells in rows and having approximately the same number of gate lines as rows, comprising:

applying a video signal to a first liquid crystal cell when a gate signal is applied to a current gate line and a next gate line; and applying the video signal to a second liquid crystal cell when the gate signal is applied to the current gate line and a previous gate line.

45. The method according to claim 44, wherein the first liquid crystal cell located in the $i^{th}$ horizontal line receives the video signal when the gate signal is applied to the $i^{th}$ gate line and the $(i-1)^{th}$ gate line, wherein i is a natural number.

46. The method according to claim 44, wherein the second liquid crystal cell located in the $i^{th}$ horizontal line receives the video signal when the gate signal is applied to the $i^{th}$ gate line and the $(i-2)^{th}$ gate line, wherein i is a natural number.

* * * * *